US011263947B2

(12) United States Patent
Wu et al.

(10) Patent No.: US 11,263,947 B2
(45) Date of Patent: Mar. 1, 2022

(54) DISPLAY PANEL AND DRIVING METHOD THEREOF, DRIVING DEVICE AND DRIVING SYSTEM

(71) Applicants: BEIJING BOE DISPLAY TECHNOLOGY CO., LTD., Beijing (CN); BOE TECHNOLOGY GROUP CO., LTD., Beijing (CN)

(72) Inventors: Jun Wu, Beijing (CN); Ruizhi Yang, Beijing (CN); Yang You, Beijing (CN); Ruiyong Wang, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 377 days.

(21) Appl. No.: 16/471,030

(22) PCT Filed: Oct. 25, 2018

(86) PCT No.: PCT/CN2018/111952
§ 371 (c)(1),
(2) Date: Jun. 19, 2019

(87) PCT Pub. No.: WO2019/179098
PCT Pub. Date: Sep. 26, 2019

(65) Prior Publication Data

US 2021/0335185 A1 Oct. 28, 2021

(30) Foreign Application Priority Data

Mar. 22, 2018 (CN) ..... 201810239806.4

(51) Int. Cl.
*G09G 3/20* (2006.01)

(52) U.S. Cl.
CPC ... *G09G 3/2003* (2013.01); *G09G 2310/0278* (2013.01); *G09G 2370/16* (2013.01)

(58) Field of Classification Search
None
See application file for complete search history.

(56) References Cited

U.S. PATENT DOCUMENTS

2011/0063510 A1 3/2011 Lee et al.
2013/0208027 A1* 8/2013 Bae ..... G09G 3/3426 345/690

(Continued)

FOREIGN PATENT DOCUMENTS

CN 102592543 A 7/2012
CN 105551417 A 5/2016

(Continued)

OTHER PUBLICATIONS

International Search Report and Written Opinion in corresponding International Patent Application No. PCT CN2018/111952 dated Jan. 30, 2019 (an English translation attached hereto). 15 pages.

*Primary Examiner* — Matthew Yeung
(74) *Attorney, Agent, or Firm* — Leason Ellis LLP

(57) ABSTRACT

A display panel and a driving method thereof, a drive device, and a drive system. The display panel includes a plurality of data lines, a plurality of gate lines, and a pixel array. The pixel array includes a communication pixel including a communication sub-pixel; the first communication gate line of the plurality of gate lines connected to the communication sub-pixel is configured to transmit a first scan signal which includes a display scan sub-signal and a first communication scan sub-signal, the first communication data line of the plurality of data lines connected to the communication sub-pixel is configured to transmit a first data signal which includes a first display data sub-signal and a first communication data sub-signal; and the communication sub-pixel is (Continued)

configured to display information corresponding to the first display data sub-signal and information corresponding to the first communication data sub-signal in a time-sharing manner.

16 Claims, 10 Drawing Sheets

(56) References Cited

U.S. PATENT DOCUMENTS

| | | | | |
|---|---|---|---|---|
| 2015/0254491 | A1* | 9/2015 | Mo | G06K 9/0002 345/174 |
| 2018/0101271 | A1* | 4/2018 | Tsai | G09G 3/3225 |

FOREIGN PATENT DOCUMENTS

| | | | |
|---|---|---|---|
| CN | 107404354 | A | 11/2017 |
| CN | 108172194 | A | 6/2018 |
| KR | 100981578 | B1 | 9/2010 |

* cited by examiner

DISPLAY PANEL AND DRIVING METHOD THEREOF, DRIVING DEVICE AND DRIVING SYSTEM

CROSS-REFERENCE TO RELATED PATENT APPLICATIONS

The present application is a U.S. National Stage Application under 35 U.S.C. § 371 of International Patent Application No. PCT/CN2018/111952, filed Oct. 25, 2018, which claims priority to Chinese Patent Application No. 201810239806.4, filed Mar. 22, 2018, both of which are incorporated by reference in their entireties as part of the present application.

TECHNICAL FIELD

Embodiments of the present disclosure relate to a display panel and a driving method thereof, a driving device, and a driving system.

BACKGROUND

Visible Light Communication (VLC) refers to a communication method in which an optical signal is directly transmitted in the air by using light in the visible light band as an information carrier, and a transmission medium of a wired channel such as an optical fiber is not required. The basic principle of VLC is to convert a communication signal into a high voltage signal and a low voltage signal by using a modulator; the high voltage signal and the low voltage signal can then be transmitted in the air through the high-frequency blinking optical signal; finally, the optical receiver receives optical information, and the demodulator converts the received optical information into usable information. VLC has the advantages of being green and low carbon, low energy consumption (nearly zero energy consumption), no electromagnetic radiation, wide bandwidth, high speed, low costs and high confidentiality.

SUMMARY

At least one embodiment of the present disclosure provides a display panel, which comprises a plurality of data lines, a plurality of gate lines, and a pixel array, wherein the pixel array comprises a communication pixel comprising a communication sub-pixel, a gate line connected to the communication sub-pixel is a first communication gate line, and a data line connected to the communication sub-pixel is a first communication data line;

the first communication gate line is configured to transmit a first scan signal, the first scan signal comprises a display scan sub-signal and a first communication scan sub-signal, the first communication data line is configured to transmit a first data signal, the first data signal comprises a first display data sub-signal and a first communication data sub-signal;

and the communication sub-pixel is configured to display information corresponding to the first display data sub-signal and information corresponding to the first communication data sub-signal in a time-sharing manner under a control of the display scan sub-signal and the first communication scan sub-signal.

For example, in the display panel provided by at least one embodiment of the present disclosure, each pixel of the pixel array comprises a plurality of sub-pixels, in the each pixel, the plurality of sub-pixels are respectively connected to different gate lines and respectively connected to different data lines.

For example, in the display panel provided by at least one embodiment of the present disclosure, the communication sub-pixel is a first sub-pixel of the communication pixel, the communication pixel further comprises a second sub-pixel and a third sub-pixel, a gate line connected to the second sub-pixel of the communication pixel is a second communication gate line, and a gate line connected to the third sub-pixel of the communication pixel is a third communication gate line, a data line connected to the second sub-pixel of the communication pixel is a second communication data line, and a data line connected to the third sub-pixel of the communication pixel is a third communication data line, the second communication gate line is configured to transmit a second scan signal, the second scan signal comprises a corresponding display scan sub-signal and a second communication scan sub-signal, and the third communication gate line is configured to transmit a third scan signal, the third scan signal comprises a display scan sub-signal and a third communication scan sub-signal, and the second communication data line is configured to transmit a second data signal, the second data signal comprises a second display data sub-signal and a second communication data sub-signal, and the third communication data line is configured to transmit a third data signal, the third data signal comprises a third display data sub-signal and a third communication data sub-signal.

For example, in the display panel provided by at least one embodiment of the present disclosure, the second sub-pixel and the third sub-pixel are non-communication sub-pixels, and the second communication scan sub-signal and the third communication scan sub-signal are associated with at least the first communication scan sub-signal.

For example, in the display panel provided by at least one embodiment of the present disclosure, the first communication data sub-signal, the second communication data sub-signal, and the third communication data sub-signal are all dark-state signals, and the first display data sub-signal is a light-state signal.

For example, in the display panel provided by at least one embodiment of the present disclosure, the first sub-pixel, the second sub-pixel, and the third sub-pixel are different communication sub-pixels, and the first communication scan sub-signal, the second communication scan sub-signal, and the third communication scan sub-signal are determined based on communication information transmitted by the first sub-pixel, the second sub-pixel, and the third sub-pixel, respectively.

For example, in the display panel provided by at least one embodiment of the present disclosure, the first communication data sub-signal, the second communication data sub-signal, and the third communication data sub-signal are all dark-state signals, and the first display data sub-signal, the second display data sub-signal, and the third display data sub-signal are all light-state signals.

For example, in the display panel provided by at least one embodiment of the present disclosure, the plurality of data lines extend in a first direction, and the plurality of gate lines extend in a second direction, in the each pixel, colors of the plurality of sub-pixels are different from each other, and the plurality of sub-pixels are sequentially arranged in the first direction;

the plurality of gate lines are configured to be connected to sub-pixels of a same color in a same row in the second direction, respectively; and the plurality of data lines are configured to be connected to sub-pixels of a same color in a same column in the first direction, respectively.

For example, in the display panel provided by at least one embodiment of the present disclosure, gate lines of the plurality of gate lines connected to non-communication pixels are configured to transmit corresponding display scan sub-signals, data lines of the plurality of data lines connected to the non-communication pixels are configured to transmit corresponding display data sub-signals, respectively, the non-communication pixels are configured to display information corresponding to the corresponding display data sub-signals, respectively.

For example, in the display panel provided by at least one embodiment of the present disclosure, each pixel of the pixel array comprises a plurality of sub-pixels, in the each pixel, the plurality of sub-pixels are respectively connected to different gate lines and connected to a same data line.

For example, in the display panel provided by at least one embodiment of the present disclosure, communication information transmitted by the communication sub-pixel is determined by a light-dark frequency of an optical signal emitted by the communication sub-pixel.

At least one embodiment of the present disclosure further provides a driving device configured to be applied to the display panel any of the embodiments of the present disclosure, the driving device comprising a gate driver and a data driver, wherein the gate driver is configured to output the first scan signal to the first communication gate line; and the data driver is configured to output the first data signal to the first communication data line.

For example, the driving device provided by at least one embodiment of the present disclosure further comprises a modulator, wherein the modulator is configured to determine the first communication scan sub-signal and the first communication data sub-signal based on communication information transmitted by the communication sub-pixel.

At least one embodiment of the present disclosure further provides a drive system, which comprises the drive device according to any of the embodiments of the present disclosure, an optical receiver and a demodulator, wherein the optical receiver is configured to detect an optical signal of the communication sub-pixel, convert the optical signal into an electrical signal, and transmit the electrical signal to the demodulator, and the demodulator is configured to demodulate the electrical signal to obtain communication information transmitted by the communication sub-pixel.

At least one embodiment of the present disclosure further provides a driving method of the display panel according to any of the embodiments of the present disclosure, the method comprising:

determining the first communication scan sub-signal and the first communication data sub-signal, based on the communication information transmitted by the communication sub-pixel;

outputting, to the first communication gate line, the first scan signal comprising the first communication scan sub-signal; and outputting, to the first communication data line, the first data signal comprising the first communication data sub-signal.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

DETAILED DESCRIPTION

In order to make objects, technical details and advantages of the embodiments of the present disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for invention, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Figure 1A:
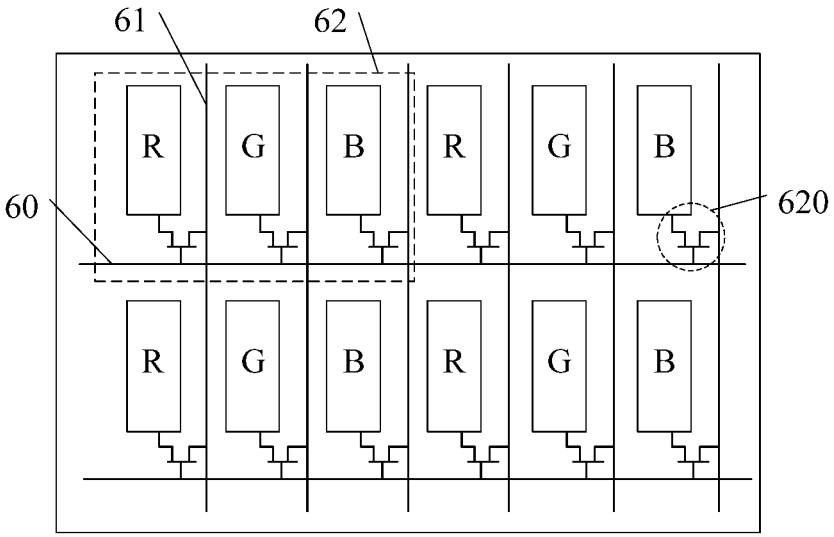
FIG. 1A is a schematic diagram of a display panel.
Figure 1B:
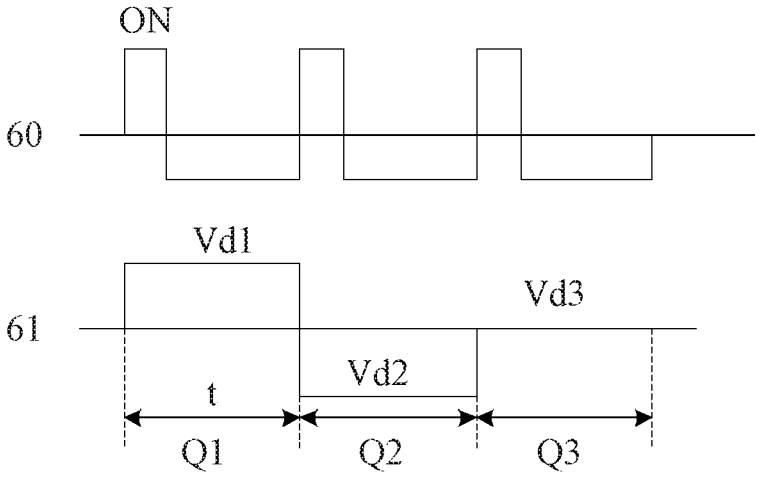
FIG. 1B is a driving timing diagram of the display panel shown in FIG. 1A.

FIG. 1A is a schematic diagram of a display panel, and FIG. 1B is a driving timing diagram of the display panel shown in FIG. 1A. For example, as shown in FIG. 1A, the display panel includes pixel units 62 arranged in a plurality of rows and a plurality of columns, gate lines 60, and data lines 61. Each pixel unit 62 includes three sub-pixels, i.e., a red sub-pixel R, a green sub-pixel G, and a blue sub-pixel B. Each pixel unit 62 further includes three driving transistors 620, which are respectively in one-to-one correspondence with the three sub-pixels. A gate of the driving transistor 620 is electrically connected to the gate line 60, a source of the driving transistor 620 is electrically connected to the data line 61, and a drain of the driving transistor 620 is electrically connected to the corresponding sub-pixel. For example, as shown in FIGS. 1A and 1B, when the gate line 60 supplies a turn-on signal ON to the gate of the driving transistor 620 (for example, the turn-on signal ON is a pulse signal), the driving transistor 620 is turned on so that the data line 61 is electrically connected to the sub-pixel of the corresponding pixel unit 62, and a data signal applied on the data line 61 can be transmitted to the sub-pixel of the corresponding pixel unit 62. As a result, display information corresponding to the data signal can be displayed by the sub-pixel of the corresponding pixel unit 62. For example, FIG. 1B shows a driving timing diagram of the display panel in a three-frame display time. As shown in FIG. 1B, the refresh frequency of the display panel is 60 Hz, that is, the scanning frequency of the turn-on signal ON on the gate line 60 is 60 Hz, and the display time t of one frame is 16.7 ms. If the data signal Vd1 is a positive high voltage signal (e.g., +5V) in the first frame Q1, the data signal Vd2 is a negative high voltage signal (e.g., −5V) in the second frame Q2, and the data signal Vd3 is a low voltage signal (for example, 0V) in the third frame Q3, the display information corresponding to the positive high voltage signal and the negative high voltage signal may be represented as 1, and the display information corresponding to the low voltage signal may be represented as 0, the information displayed by the sub-pixel on the display panel corresponding to the data line 61 shown in FIG. 1B may be represented as 110 within three frames.

For example, the visible light communication technology utilizes a high-frequency light-dark blinking signal to realize information transmission, and the high-frequency light-dark blinking signal may be realized by a switch quickly controlling a fluorescent lamp or a light emitting diode, etc. In the display panel, the driving transistor 620 may be a thin film transistor (TFT). The switching time of the TFT is short, usually on the order of nanoseconds, that is, the TFT has the characteristics of fast switching and may meet the requirement of a high refresh frequency.

At least one embodiment of the present disclosure provides a display panel and a driving method thereof, a driving device, and a driving system, which may apply visible light communication technology to a display panel, and realize visible light communication on the display panel by inserting light-dark information into the original display image after the refresh frequency of the display panel is increased, by taking advantage of the characteristics that the thin film transistor may be quickly switched on or off.

The embodiments of the present disclosure are described in detail below with reference to the accompanying drawings, but the present disclosure is not limited to these particular embodiments.

Figure 2A:
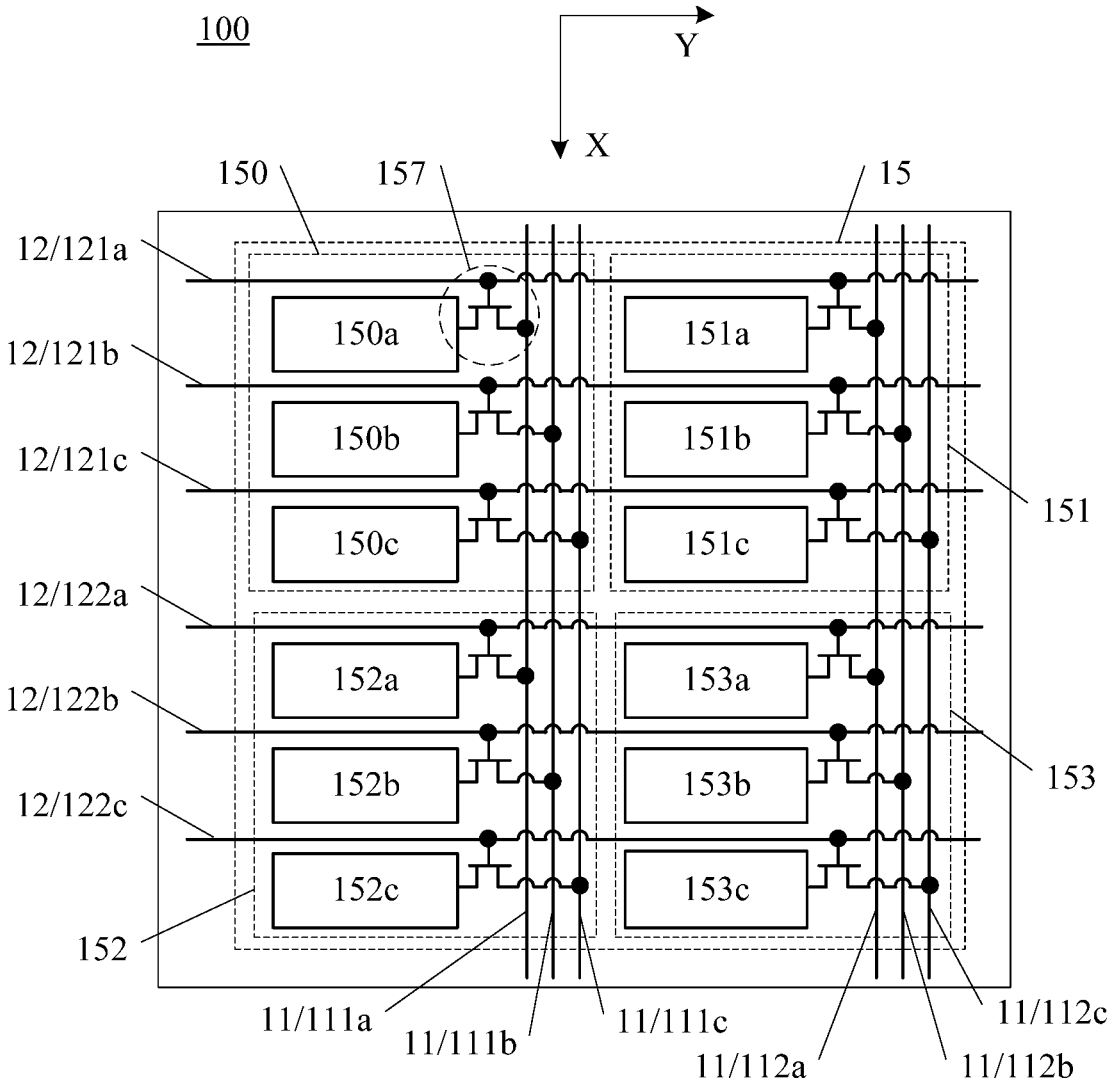
FIG. 2A is a schematic diagram of a display panel provided by an embodiment of the present disclosure.
Figure 2B:
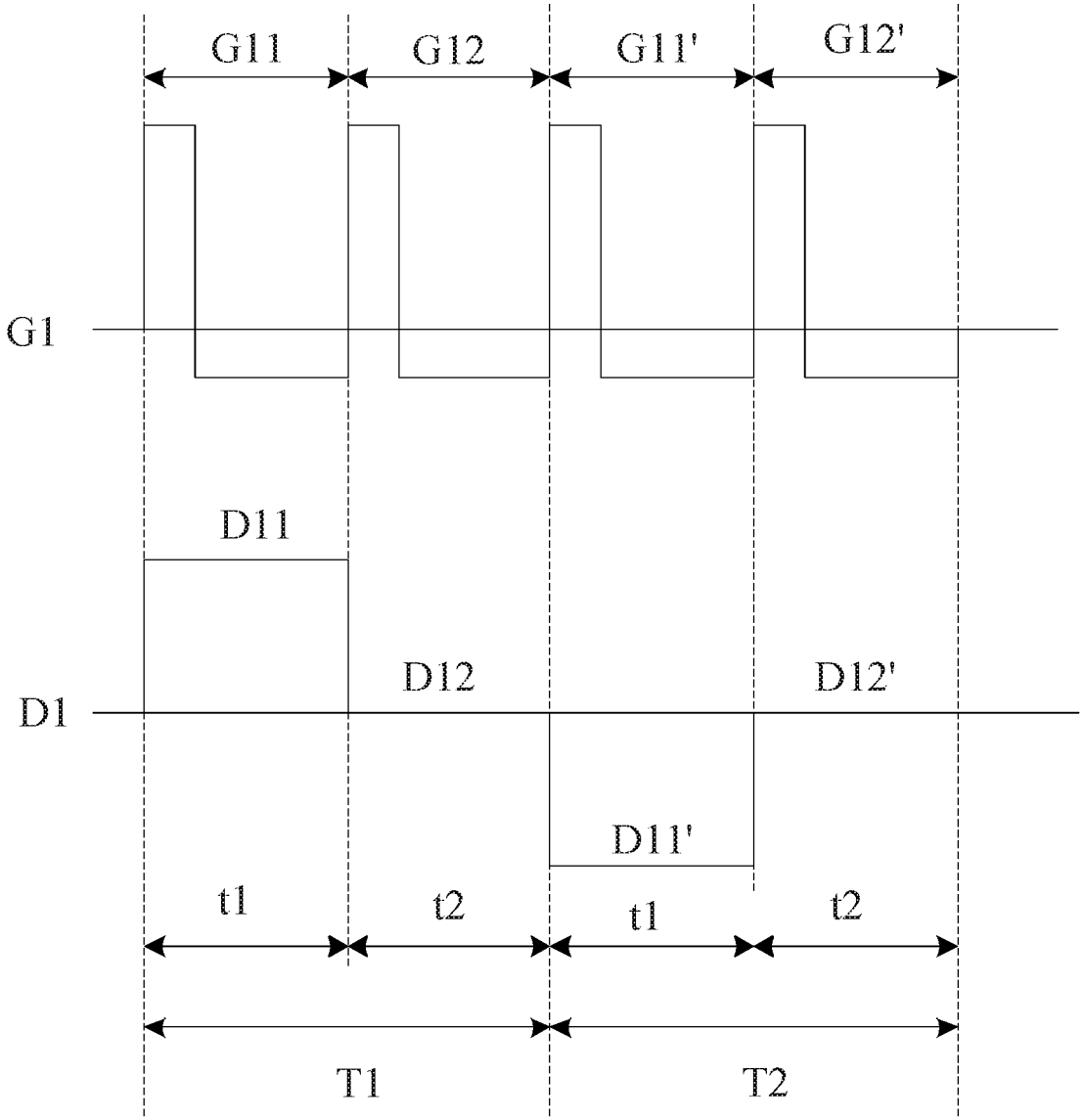
FIG. 2B is a timing diagram of a first communication gate line and a first communication data line in a display panel provided by an embodiment of the present disclosure.

FIG. 2A is a schematic diagram of a display panel provided by an embodiment of the present disclosure. FIG. 2B is a timing diagram of a first communication gate line and a first communication data line in a display panel provided by an embodiment of the present disclosure.

For example, as shown in FIG. 2A, a display panel 100 provided by the embodiment of the present disclosure includes a plurality of data lines 11, a plurality of gate lines 12, and a pixel array 15. The pixel array 15 includes a communication pixel 150, the communication pixel 150 includes a communication sub-pixel 150*a*, the gate line connected to the communication sub-pixel 150*a* is the first communication gate line 121*a*, and the data line connected to the communication sub-pixel 150*a* is the first communication data line 111*a*. The pixel array 15 also includes non-communication pixels.

For example, the communication pixel 150 is a pixel for transmitting communication information. For example, at least one sub-pixel of the communication pixel 150 is used to transmit communication information and is referred to as a communication sub-pixel. The non-communication pixels are pixels that don't transmit communication information. For example, none of the non-communication pixels transmit communication information. For example, the communication information may include visible light communication information, for example, the visible light communication information is a high-frequency blinking (i.e., light-dark) optical signal emitted by the sub-pixel.

For example, as shown in FIG. 2B, the first communication gate line 121*a* is configured to transmit a first scan signal G1 including a display scan sub-signal and a first communication scan sub-signal, and the first communication data line 111*a* is configured to transmit a first data signal D1 including a first display data sub-signal and a first communication data sub-signal. Under the control of the display scan sub-signal and the first communication scan sub-signal, the communication sub-pixel 150*a* is configured to display the information corresponding to the first display data sub-signal and the information corresponding to the first communication data sub-signal in a time-sharing manner.

For example, the information corresponding to the first display data sub-signal is display information, and the information corresponding to the first communication data sub-signal is communication information. The communication information may be, for example, visible light communication information.

For example, the display panel 100 may be a liquid crystal display panel, an organic light emitting diode display panel, etc.

For example, the display time of one frame of the display panel 100 may be 16.7 ms. In case of normal display (that is, in the case where communication information is not inserted), the refresh frequency of the display panel 100 is F1, and in case of inserting communication information, the refresh frequency of the display panel 100 is F2, and F2 is greater than F1. For example, F1 may be 60 Hz, so that the scanning time within one frame is 16.7 ms in case of normal display, that is, the time during which the gate line 12 of the first line of the display panel 200 to the gate line 12 of the last line of the display panel 200 are scanned may be 16.7 ms within one frame, so that the scanning time is the same as the display time. F2 may be 120 Hz, 200 Hz, etc. When F2 is 120 Hz, the scanning time within one frame is 8.3 ms in case of inserting communication information, that is, the time during which the gate line 12 of the first line of the display panel 200 to the gate line 12 of the last line of the display panel 200 are scanned within one frame may be 8.3 ms, so that the scanning time is half of the display time.

For example, in the pixel array 15, each sub-pixel includes a driving circuit and a sub-pixel electrode (not shown). The drive circuit is configured to drive the sub-pixel electrodes to display information during the display phase. As shown in FIG. 2A, if the display panel 100 is a liquid crystal display panel, the driving circuit may include a driving transistor 157. A gate of the driving transistor 157 is electrically connected to the gate line 12, a first electrode of the driving transistor 157 is electrically connected to the data line 11, and a second electrode of the driving transistor 157 is electrically connected to the sub-pixel electrode. A scanning signal transmitted by the gate line 12 is used to control the driving transistor 157 to be turned on or off. If the display panel 100 is an organic light emitting diode display panel, the driving circuit may include a driving transistor and a data input transistor. A gate of the data input transistor is electrically connected to the gate line 12, a first electrode of the data input transistor is electrically connected to the data line 11, a second electrode of the data input transistor is electrically connected to a gate of the driving transistor, a first electrode of the driving transistor is electrically connected to a power terminal, and a second electrode of the driving transistor is electrically connected to the sub-pixel electrode. A scanning signal transmitted by the gate line 12 is used to control the data input transistor to be turned on or off.

For example, each of the driving transistor and the data input transistor may be a thin film transistor or a field effect transistor or other switching elements with the same characteristics. The thin film transistor may include a poly-silicon (low temperature poly-silicon or high temperature poly-silicon) thin film transistor, an amorphous silicon thin film transistor, an oxide thin film transistor, an organic thin film transistor, etc. The source electrode and the drain electrode of a transistor may be symmetrical in structure, so the source electrode and the drain electrode of the transistor may have no difference in structure. In the embodiment of the present disclosure, in order to distinguish two electrodes of the transistor other than the gate electrode which is used as the control electrode, one electrode is directly described as the first electrode and the other electrode is directly described as the second electrode, so the first electrodes and the second electrodes of all the or some transistors in the embodiments of the present disclosure may be exchanged as required. For example, transistors may be divided into N-type transistors and P-type transistors according to the characteristics of the transistors. For example, description is given in the embodiment of the present disclosure by taking the case that the driving transistor and the data input transistor may be N-type transistors (for example, an N-type MOS transistor) as an example, and the embodiment of the present disclosure is not limited thereto.

It should be noted that the structure of the driving circuit includes, but is not limited to, a driving transistor and/or a data input transistor, and may further include more transistors. For example, it may be implemented by the basic structure of a pixel driving circuit, such as 4T1C, 4T2C or 8T2C, which are conventional structures in the art.

For example, in the display panel 100, when the driving transistor 157 is controlled to be quickly switched, the sub-pixel (for example, the communication sub-pixel 150*a*) may emit a high-frequency blinking optical signal, which may be visible light communication information. For example, the visible light communication information (optical signal) may be received by the optical receiver and demodulated by the demodulator to complete the transmission thereof, so that the display panel 100 may realize the transmission of the visible light communication information.

For example, the communication information transmitted by the communication sub-pixel 150*a* is determined by the light-dark frequency of the optical signal emitted by the communication sub-pixel 150*a*. The light-dark frequency of the optical signal emitted by the communication sub-pixel 150*a* is determined by the first scan signal G1 and the first data signal D1.

For example, if the display panel 100 is a liquid crystal display panel, each of the display scan sub-signal and the first communication scan sub-signal in the first scan signal G1 is used to control the driving transistor 157 in the communication sub-pixel 150*a* to be turned on, and thus the display scan sub-signal may be the same as the first communication scan sub-signal.

For example, the display scan sub-signal and the first communication scan sub-signal both are pulse signals.

For example, in one frame, the first scan signal G1 may include a display scan sub-signal and at least one first communication scan sub-signal, and the first data signal D1 may include a first display data sub-signal and at least one first communication data sub-signal. The display scan sub-signal corresponds to the first display data sub-signal, that is, controlling whether the driving circuit is turned on or not by the display scan sub-signal, thereby controlling whether the first display data sub-signal is transmitted to the communication sub-pixel 150*a* connected to the driving circuit for display. The first communication scan sub-signal corresponds to the first communication data sub-signal, that is, the number of the first communication scan sub-signals is the same as the number of the first communication data sub-signals, and the plurality of first communication scan sub-signals are in one-to-one correspondence with the plurality of first communication data sub-signals.

For example, FIG. 2B shows only a timing diagram of the first communication gate line 121*a* and the first communication data line 111*a* within two frames (i.e., the first frame T1 and the second frame T2). In an example, the refresh frequency F2 of the display panel 100 may be 120 Hz. In the first frame T1, the first scan signal G1 includes a display scan sub-signal G11 and a first communication scan sub-signal G12, and the first data signal D1 includes a first display data sub-signal D11 and a first communication data sub-signal D12. In the second frame T2, the first scan signal G1 also includes a display scan sub-signal G11' and a first communication scan sub-signal G12', and the first data signal D1 includes a first display data sub-signal D11' and a first communication data sub-signal D12'.

For example, the display scan sub-signal G11 is the same as the display scan sub-signal G11' (for example, the pulse width (i.e., pulse duration), pulse amplitude, duty ratio, etc. of the pulse signal are the same), the first communication scan sub-signal G12 is also the same as the first communication scan sub-signal G12' (for example, the pulse width (i.e., pulse duration), pulse amplitude, duty ratio, etc. of the pulse signal are the same). Thereby, the display scan sub-signal G11, the display scan sub-signal G11', the first communication scan sub-signal G12, and the first communication scan sub-signal G12' are all the same. However, the display scan sub-signal G11, the display scan sub-signal G11', the first communication scan sub-signal G12, and the first communication scan sub-signal G12' may be different, and the embodiment of the present disclosure is not limited thereto.

For example, as shown in FIG. 2B, in the first frame T1, the duration of the first display data sub-signal D11 is t1, and the duration of the first communication data sub-signal D12 is t2; and in the second frame T2, the duration of the first display data sub-signal D11' is also t1, and the duration of the first communication data sub-signal D12' is also t2. For example, t1 is 8.3 ms and t2 is also 8.3 ms. In the first frame T1 and the second frame T2, the scan time is t1 (i.e., 8.3 ms), that is, during the time t1, the gate line 12 on the display panel 100 performs a scanning operation (for example, progressive scanning), and all the pixels on the display panel 100 operate normally. At this time, the communication pixel 150 displays the light state information; during the time t2, the communication pixel 150 in the display panel 100 displays the dark state information. Therefore, the communication pixel 150 realizes a light-dark change, and the optical signal of the light-dark change is visible light communication information, thereby transmitting communication information.

For example, the luminance of the light state signal is greater than the dark state signal. The absolute value of the first display data sub-signal is greater than the first communication data sub-signal, so that the information corresponding to the first display data sub-signal is the light state information, and the information corresponding to the first communication data sub-signal is the dark state information.

For example, the first display data sub-signal is determined based on the content displayed in each frame, and the polarities of the first display data sub-signals in two adjacent frames may be opposite. As shown in FIG. 2B, when the first frame T1 and the second frame T2 are two adjacent frames, and the content displayed in the first frame T1 is the same as the second frame T2, the value of the first display data sub-signal D11 may be the same as the first display data sub-signal D11'. If the first display data sub-signal D11 is a positive high voltage signal, the first display data sub-signal D11' is a negative high voltage signal, and the absolute value of the positive high voltage signal is the same as the negative high voltage signal. Certainly, the embodiments of the present disclosure are not limited thereto, and the first display data sub-signal D11 and the first display data sub-signal D11' may also be positive high voltage signals, etc. For example, the first display data sub-signal D11 is +5V, and the first display data sub-signal D11' is −5V. When the content displayed in the first frame T1 is different from the second frame T2, the first display data sub-signal D11 may be +4V, and the first display data sub-signal D11' is −3V.

For example, the first communication data sub-signal D12 and the first communication data sub-signal D12' may be the same or different as long as the absolute value of the first communication data sub-signal D12 is smaller than the first display data sub-signal D11 and the absolute value of the first communication data sub-signal D12' is smaller than the first display data sub-signal D11'. For example, each of the first communication data sub-signal D12 and the first communication data sub-signal D12' is 0V.

For example, if the value of the first display data sub-signal D11 is the same as the first display data sub-signal D11', and the first communication data sub-signal D12 is the same as the first communication data sub-signal D12', the luminance of the communication sub-pixel 150*a* in the first frame is the same as the second frame T2. If the value of the first display data sub-signal D11 is different from the first display data sub-signal D11', and/or the first communication data sub-signal D12 is different from the first communication data sub-signal D12', the luminance of the communication sub-pixel 150*a* in the first frame T1 is different from the second frame T2.

For example, if the display information corresponding to the first display data sub-signal D11 and the first display data sub-signal D11' may be represented as 1, and the display information corresponding to the first communication data sub-signal D12 and the first communication data sub-signal D12' may be represented as 0, the information displayed by the communication sub-pixel 150*a* in the first frame T1 and the second frame T2 may be represented as 1010, that is, the communication information transmitted by the communication sub-pixel 150*a* is 1010.

Figure 2C:
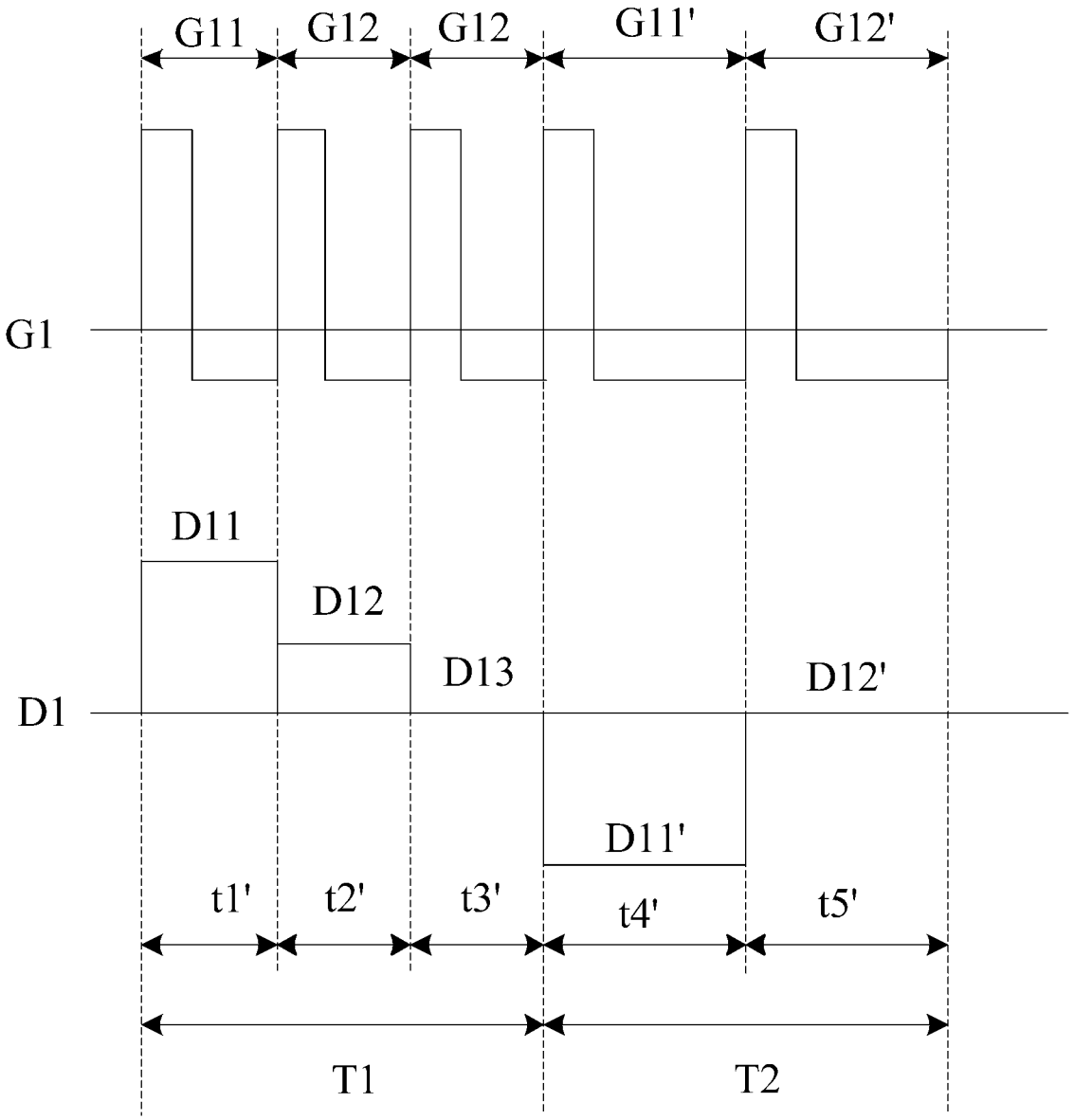
FIG. 2C is another timing diagram of a first communication gate line and a first communication data line in a display panel provided by an embodiment of the present disclosure.

FIG. 2C is another timing diagram of a first communication gate line and a first communication data line in a display panel provided by an embodiment of the present disclosure.

For example, the scanning time of the display panel 100 in the first frame T1 may be different from the second frame T2, that is, the duration of the first display data sub-signal D11 may be different from the first display data sub-signal D11'. As shown in FIG. 2C, in the first frame T1, the first scan signal G1 includes a display scan sub-signal G11 and two first communication scan sub-signals G12, and the first data signal D1 includes a first display data sub-signal D11 and two first communication data sub-signals (i.e., the first communication data sub-signal D12 and the first communication data sub-signal D13). In the second frame T2, the first scan signal G1 includes a display scan sub-signal G11' and a first communication scan sub-signal G12', the first data signal D1 includes a first display data sub-signal D11' and a first communication data sub-signal D12'. Thus, in the first frame T1, the duration of the first display data sub-signal D11 is t1' which is about 5.6 ms, the duration of the first communication data sub-signal D12 is t2' which is about 5.6 ms, and the duration of the first communication data sub-signal D13 is t3' which is about 5.6 ms. In the second frame T2, the duration of the first display data sub-signal D11' is t4' which is 8.3 ms, and the duration of the first communication data sub-signal D12' is t5' which is 8.3 ms. In the first frame T1, the scan time is t1', that is, 5.6 ms, and in the second frame T2, the scan time is t4', that is, 8.3 ms.

For example, the first communication data sub-signal D12 may be different from the first communication data sub-signal D13, but the absolute values of the first communication data sub-signal D12 and the first communication data sub-signal D13 are both smaller than the absolute value of the first display data sub-signal D11. For example, the first display data sub-signal D11 may be 5V, the first communication data sub-signal D12 is 2V, and the first communication data sub-signal D13 is 0V.

For example, as shown in FIG. 2A, a plurality of data lines 11 extend in a first direction X, and a plurality of gate lines 12 extend in a second direction Y. The pixel array 15 includes a plurality of pixels, and the plurality of pixels are arranged in an array in the first direction X and the second direction Y. For example, FIG. 2A shows four pixels, which include a communication pixel 150, a first non-communication pixel 151, a second non-communication pixel 152, and a third non-communication pixel 153. The communication pixel 150 and the first non-communication pixel 151 are located in the same row, the second non-communication pixel 152 and the third non-communication pixel 153 are located in the same row, and the communication pixel 150 and the second non-communication pixel 152 are located in the same column, the first non-communication pixel 151 and the third non-communication pixel 153 are located in the same column, so that the four pixels are arranged in two rows and two columns.

For example, each pixel of the pixel array 15 includes a plurality of sub-pixels, and the plurality of sub-pixels in each pixel are connected to different gate lines, respectively, and connected to different data lines, respectively.

For example, as shown in FIG. 2A, in each pixel, the colors of the plurality of sub-pixels are different from each other, and the plurality of sub-pixels are sequentially arranged in the first direction X.

It should be noted that in each pixel, at least a part of the colors of the plurality of sub-pixels may be the same, and the plurality of sub-pixels may also be sequentially arranged in the second direction Y, which is not limited by the disclosure.

For example, as shown in FIG. 2A, in an example, each pixel includes three sub-pixels, which include a red sub-pixel, a blue sub-pixel, and a green sub-pixel. However, the embodiments of the present disclosure are not limited thereto, and the three sub-pixels may also be sub-pixels of other colors. In addition, each pixel may also include four sub-pixels, which include a red sub-pixel, a blue sub-pixel, a green sub-pixel, and a white sub-pixel.

For example, as shown in FIG. 2A, the communication pixel 150 which is the first sub-pixel 150*a* of the communication pixel 150 includes a first sub-pixel 150*a*, a second sub-pixel 150*b*, and a third sub-pixel 150*c*. The first non-communication pixel 151 includes a first sub-pixel 151*a*, a second sub-pixel 151*b*, and a third sub-pixel 151*c*. The second non-communication pixel 152 includes a first sub-pixel 152*a*, a second sub-pixel 152*b*, and a third sub-pixel 152*c*. The third non-communication pixel 153 includes a first sub-pixel 153*a*, a second sub-pixel 153*b*, and a third sub-pixel 153*c*.

For example, each gate line 12 is configured to be connected to sub-pixels of the same color in the same row along the second direction Y, respectively; each data line 11 is configured to be connected to sub-pixels of the same color in the same column along the first direction X, respectively. As shown in FIG. 2A, the first communication gate line 121*a* is connected to the first sub-pixel 150*a* of the communication pixel 150 and the first sub-pixel 151*a* of the first non-communication pixel 151, respectively, and the first communication data line 111*a* is connected to the first sub-pixel 150*a* of the communication pixel 150 and the first sub-pixel 152*a* of the second non-communication pixel 152, respectively.

For example, as shown in FIG. 2A, the gate line connected to the second sub-pixel 150*b* of the communication pixel 150 is the second communication gate line 121*b*, and the gate line connected to the third sub-pixel 150*c* of the communication pixel 150 is the third communication gate line 121*c*; the data line connected to the second sub-pixel 150*b* of the communication pixel 150 is the second communication data line 111*b*, and the data line connected to the third sub-pixel 150*c* of the communication pixel 150 is the third communication data line 111*c*.

Figure 3:
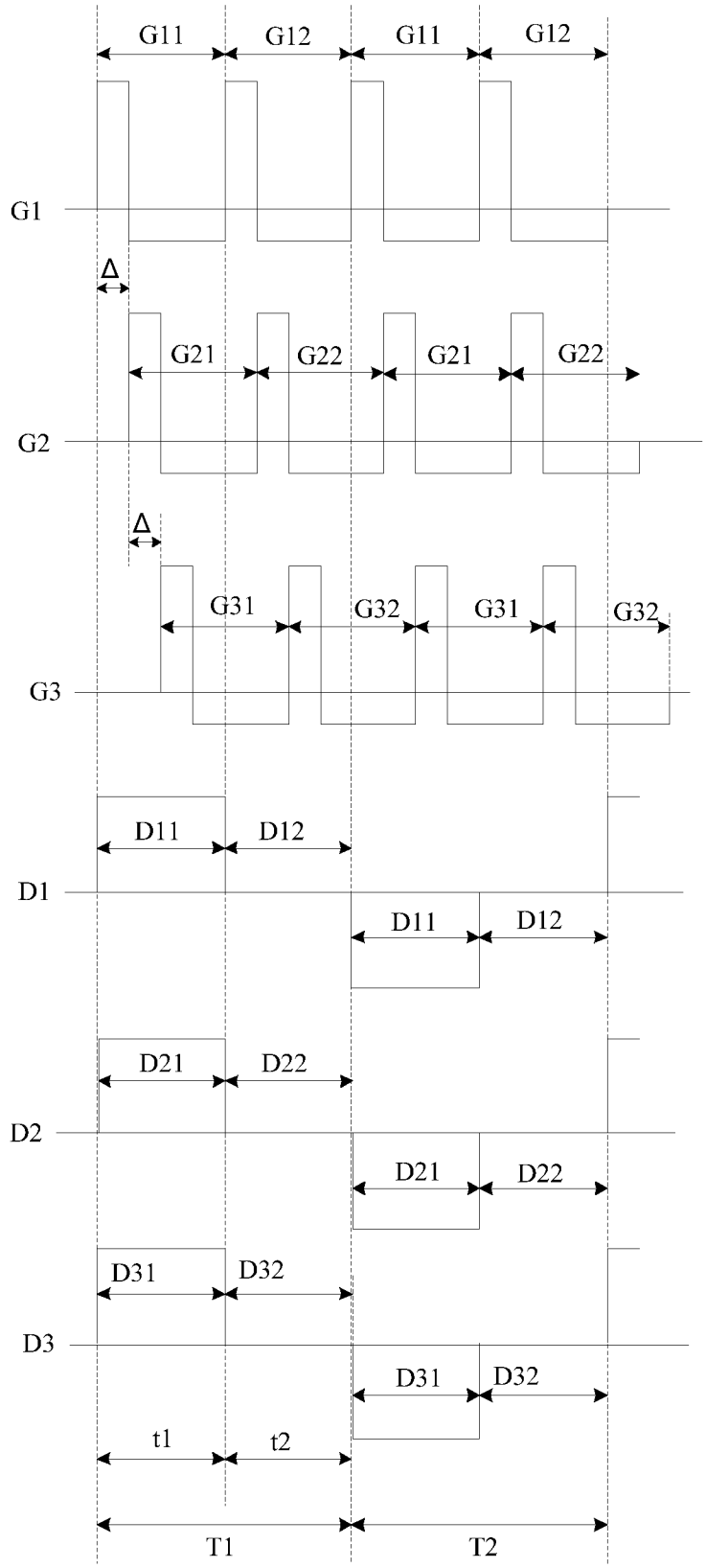
FIG. 3 is a driving timing diagram of communication pixels of a display panel provided by an embodiment of the present disclosure.

FIG. 3 is a schematic driving timing diagram of communication pixels of a display panel provided by an embodiment of the present disclosure. For example, as shown in FIG. 3, the second communication gate line 121*b* is configured to transmit a second scan signal G2 which includes a corresponding display scan sub-signal G21 and a second communication scan sub-signal G22, and the third communication gate line 121*c* is configured to transmit a third scan signal G3 which includes a corresponding display scan sub-signal G31 and a third communication scan sub-signal G32.

For example, as shown in FIG. 3, the first scan signal G1, the second scan signal G2, and the third scan signal G3 may be the same to facilitate the design of the gate circuit. For example, each of the second scan signal G2 and the third scan signal G3 is the same as the first scan signal G1 shown in FIG. 2A. The present disclosure is not limited thereto, and the first scan signal G1, the second scan signal G2, and the third scan signal G3 may be particularly set according to actual applications.

For example, because the scanning mode of the display panel 100 is progressive scanning or interlaced scanning, the first scanning signal G1, the second scanning signal G2, and the third scanning signal G3 are shifted from each other in time, for example, by a time A, and A may be a charging time of each sub-pixel.

For example, as shown in FIG. 3, in the first frame T1 or the second frame T2, the first scan signal G1 includes a display scan sub-signal G11 and a first communication scan sub-signal G12, the second scan signal G2 includes a display scan sub-signal G21 and a first communication scan sub-signal G22, and the third scan signal G3 includes a display scan sub-signal G31 and a first communication scan sub-signal G32. For example, each of t1 and t2 is 8.3 ms.

For example, in the first scan signal G1, the second scan signal G2, and the third scan signal G3, the display scan sub-signal G11, the display scan sub-signal G21, and the display scan sub-signal G31 may be the same, and the first communication scan sub-signal G12, the second communication scan sub-signal G22, and the third communication scan sub-signal G32 may also be the same.

For example, as shown in FIG. 3, the second communication data line 111*b* is configured to transmit a second data signal D2 including a second display data sub-signal D21 and a second communication data sub-signal D22, and the third communication data Line 111*c* is configured to transmit a third data signal D3 including a third display data sub-signal D31 and a third communication data sub-signal D32.

For example, as shown in FIG. 3, in the first frame T1 or the second frame T2, the first data signal D1 includes a first display data sub-signal D11 and a first communication data sub-signal D12, the second data signal D2 includes a second display data sub-signal D21 and a second communication data sub-signal D22, and the third data signal D3 includes a third display data sub-signal D31 and a third communication data sub-signal D32.

For example, the first display data sub-signal D11, the second display data sub-signal D21, and the third display data sub-signal D31 may be different, and associated with information displayed by the first sub-pixel 150*a*, the second sub-pixel 150*b*, and the third sub-pixel 150*c*, respectively. The present disclosure is not limited thereto, and the first display data sub-signal D11, the second display data sub-signal D21, and the third display data sub-signal D31 may be the same.

For example, as shown in FIG. 3, the first communication data sub-signal D12, the second communication data sub-signal D22, and the third communication data sub-signal D32 may be the same, and each of which, for example, is 0V.

For example, as shown in FIG. 3, in one frame (for example, the first frame T1 or the second frame T2), the first data signal D1, the second data signal D2, and the third data signal D3 may be changed synchronously, that is, the first display data sub-signal D11, the second display data sub-signal D21, and the third display data sub-signal D31 are simultaneously applied to the first communication data line 111*a*, the second communication data line 111*b*, and the third communication data line 111*c*, respectively, and the first communication data sub-signal D12, the second communication data sub-signal D22, and the third communication data sub-signal D32 are also simultaneously applied to the first communication data line 111*a*, the second communication data line 111*b*, and the third communication data line 111*c*, respectively.

It should be noted that the first data signal D1, the second data signal D2, and the third data signal D3 may also correspond to the first scan signal G1, the second scan signal G2, and the third scan signal G3, respectively, and the first data signal D1, the second data signal D2 and the third data signal D3 are also shifted from each other in time, for example, by a time A.

For example, in one example, the second sub-pixel 150*b* and the third sub-pixel 150*c* are non-communication sub-pixels, and the second communication scan sub-signal G22 and the third communication scan sub-signal G32 are at least associated with the first communication scan sub-signal G12. For example, each of the first communication data sub-signal D12, the second communication data sub-signal D22, and the third communication data sub-signal D32 is a dark state signal, and the first display data sub-signal is a light state signal, so that the first communication data sub-signal D12 in the dark state may be inserted in the first sub-pixel 150*a* to generate a high-frequency blinking optical signal, thereby realizing transmission of communication information. Each of the second display data sub-signal and the third display data sub-signal may be a light state signal or a dark state signal.

For example, the second communication scan sub-signal G22 and the third communication scan sub-signal G32 are also associated with the color of each sub-pixel.

For example, the first sub-pixel (i.e., communication sub-pixel 150*a*) is a blue (B) sub-pixel, the second sub-pixel 150*b* is a red (R) sub-pixel, and the third sub-pixel 150*c* is a green (G) sub-pixel. For example, the wavelengths of the three primary colors are R=700.0 nm, G=546.1 nm, B=435.8 nm, respectively, according to CIE 1931, and when the luminance ratio of RGB is 1.0000:4.5907:0.0601, white light of equal energy in neutral color is obtained. That is, when the luminance of the second sub-pixel 150*b* (i.e., the red sub-pixel) is 1.0000, the luminance of the third sub-pixel 150*c* (i.e., the green sub-pixel) is 4.5907, and the luminance of the first sub-pixel 150*a* (i.e., the blue sub-pixel) is 0.0601, the communication pixel 150 displays the white color.

Figure 4:
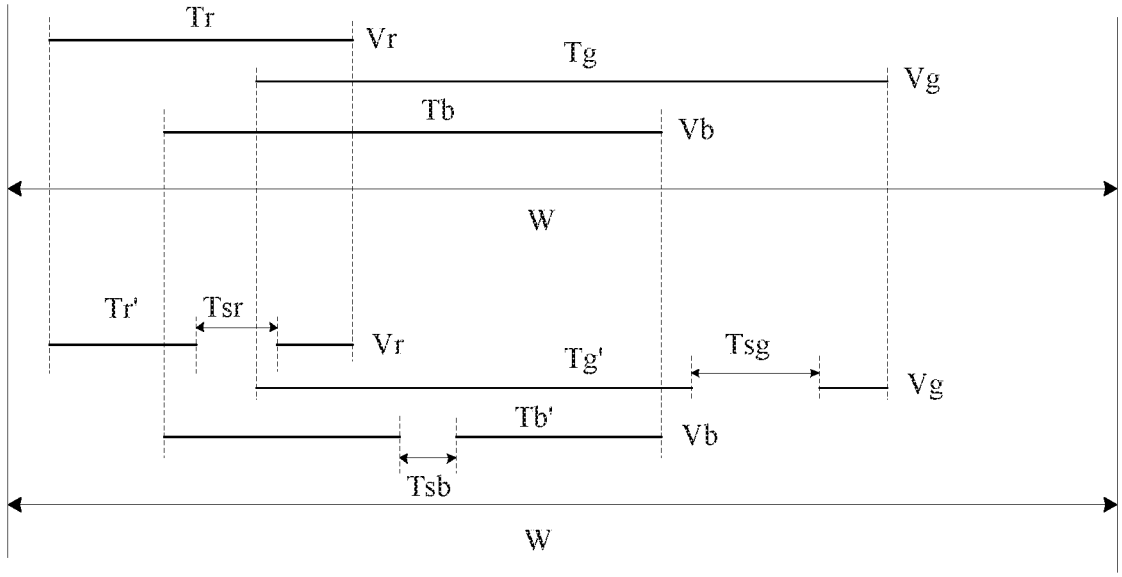
FIG. 4 is a timing diagram of communication pixels of a display panel in a preset time W provided by an embodiment of the present disclosure.

FIG. 4 is a timing diagram of communication pixels of a display panel in a preset time W provided by an embodiment of the present disclosure.

For example, as shown in FIG. 2A and FIG. 4, in a predetermined time W, in normal display, that is, without the insertion of the communication information, the display time of the communication sub-pixel 150*a* at the first voltage Vb is Tb, the display time of the second sub-pixels 150*b* at the second voltage Vr is Tr, and the display time of the third sub-pixel 150*c* at the third voltage Vg is Tg. At this time, the first image is displayed by the communication pixel 150. In the case where the communication information is inserted, in the preset time W, the communication sub-pixel 150*a* is controlled to be turned off for the time Tsb, and similarly, the second sub-pixel 150*b* and the third sub-pixel 150*c* are controlled to be turned off for the time Tsr and the time Tsg, respectively. Therefore, in the preset time W, the display time of the communication sub-pixel 150*a* at the first voltage Vb is Tb, the display time of the second sub-pixel 150*b* at the second voltage Vr is Tr', and the display time of the third sub-pixel 150*c* at the third voltage Vg is Tg'. Tb=Tb'+Tsb, Tr=Tr'+Tsr, and Tg=Tg'+Tsg. At this time, the second image is displayed by the communication pixel 150. The difference between the first image and the second image is that the integrals of the luminance of the communication sub-pixel 150*a*, the second sub-pixel 150*b*, and the third sub-pixel 150*c* are different in the preset time W, that is, the first image and the second image are only different in luminance, the luminance of the first image is greater than the second image, and the colors of the first image and the second image are the same. The ratio of the luminance of the first image to that of the second image is associated with Tsb. If Tsb is longer, Tsr and Tsg are longer, correspondingly, and the difference between the luminance of the first image and that of the second image is larger; and if Tsb is shorter, Tsr and Tsg are also shorter, correspondingly, and the difference between the luminance of the first image and that of the second image is smaller.

For example, the off time Tsb of the communication sub-pixel 150*a* is averagely distributed in Tb, the off time Tsr of the second sub-pixel 150*b* is averagely distributed in Tr, and the off time Tsg of the third sub-pixel 150*c* is averagely distributed in Tg.

For example, because the luminance ratio of RGB is 1.0000:4.5907:0.0601, Tsr:Tsg:Tsb=1.0000:4.5907:0.0601.

It should be noted that Tb, Tr, and Tg indicate the total display times of the communication sub-pixel 150*a*, the second sub-pixel 150*b*, and the third sub-pixel 150*c* within the preset time W, respectively.

For example, as shown in FIG. 4, in an example, the frequencies of the first scan signal G1, the second scan signal G2, and the third scan signal G3 are the same and are the same as the refresh frequency. The minimum time ratio Tn is the refresh time per frame, that is, 1 second/refresh frequency. When the refresh frequency is 120 Hz, Tn is 8.3 ms. Each of Tsb, Tsr, and Tsg is an integer multiple of Tn. Therefore, in the display time W, the number of the first communication scan sub-signals is Tsb/Tn, the number of the second communication scan sub-signals is Tsr/Tn, and the number of the third communication scan sub-signals is Tsg/Tn.

For example, in another example, the first sub-pixel 150*a*, the second sub-pixel 150*b*, and the third sub-pixel 150*c* are different communication sub-pixels, so that the first sub-pixel 150*a*, the second sub-pixel 150*b*, and the third sub-pixel 150*c* may transmit different communication information, respectively. The first sub-pixel 150*a*, the second sub-pixel 150*b*, and the third sub-pixel 150*c* may also transmit the same communication information.

For example, the first communication scan sub-signal G12, the second communication scan sub-signal G22, and the third communication scan sub-signal G32 are determined based on communication information transmitted by the first sub-pixel 150*a*, the second sub-pixel 150*b*, and the third sub-pixel 150*c*, respectively.

For example, the frequency of the communication information transmitted by the first sub-pixel 150*a* may be f11, the frequency of the communication information transmitted by the second sub-pixel 150*b* may be f12, and the frequency of the communication information transmitted by the third sub-pixel 150*c* may be f13. The first sub-pixel 150*a* may transmit one dark state signal every display time of two frames, the second sub-pixel 150*b* may transmit one dark state signal every display time of four frames, and the third sub-pixel 150*c* may transmit one dark state signal every display time of eight frames, so that if the display time of one frame is t0, then f11=½t0, f12=¼t0, f13=⅛t0. Thus, in the display time of eight frames, the number of the first communication scan sub-signals G12 is 4, the number of the second communication scan sub-signals G22 is 2, and the number of the third communication scan sub-signals G32 is 1.

For example, each of the first communication data sub-signal D12, the second communication data sub-signal D22, and the third communication data sub-signal D32 is a dark state signal, and each of the first display data sub-signal D11, the second display data sub-signal D21, and the third display data sub-signal D31 is a light state signal. Therefore, the first communication data sub-signal D12, the second communication data sub-signal D22, and the third communication data sub-signal D32 in the dark state may be respectively inserted into the first sub-pixel 150*a*, the second sub-pixel 150*b*, and the third sub-pixel 150*c* so as to realize the transmission of different communication information.

For example, the gate lines of the plurality of gate lines 12 connected to the non-communication pixels are non-communication gate lines, and are configured to transmit respective display scan sub-signals, and the data lines of the plurality of data lines 11 connected to the non-communication pixels are non-communication data lines, and are configured to transmit respective display data sub-signals. The non-communication pixels are configured to display information corresponding to the corresponding display data sub-signals, respectively.

For example, as shown in FIG. 2A, the plurality of gate lines 12 may include a first non-communication gate line 122*a*, a second non-communication gate line 122*b*, and a third non-communication gate line 122*c*, and the plurality of data lines 11 may include a first non-communication data line 112*a*, a second non-communication data line 112*b*, and a third non-communication data line 112*c*. The first non-communication gate line 122*a* is connected to the first sub-pixel 152*a* of the second non-communication pixel 152 and the first sub-pixel 153*a* of the third non-communication pixel 153, respectively. The second non-communication gate line 122*b* is connected to the second sub-pixel 152*b* of the second non-communication pixel 152 and the second sub-pixel 153*b* of the third non-communication pixel 153, respectively. The third non-communication gate line 122*c* is connected to the third sub-pixel 152*c* of the second non-communication pixel 152 and the third sub-pixel 153*c* of the third non-communication pixel 153, respectively. The first non-communication data line 112*a* is connected to the first sub-pixel 151*a* of the first non-communication pixel 151 and the first sub-pixel 153*a* of the third non-communication pixel 153, respectively. The second non-communication data line 112*b* is respectively connected to the second sub-pixel 151*b* of the first non-communication pixel 151 and the second sub-pixel 153*b* of the third non-communication pixel 153. The third non-communication data line 112*c* is connected to the third sub-pixel 151*c* of the first non-communication pixel 151 and the third sub-pixel 153*c* of the third non-communication pixel 153, respectively.

Figure 5:
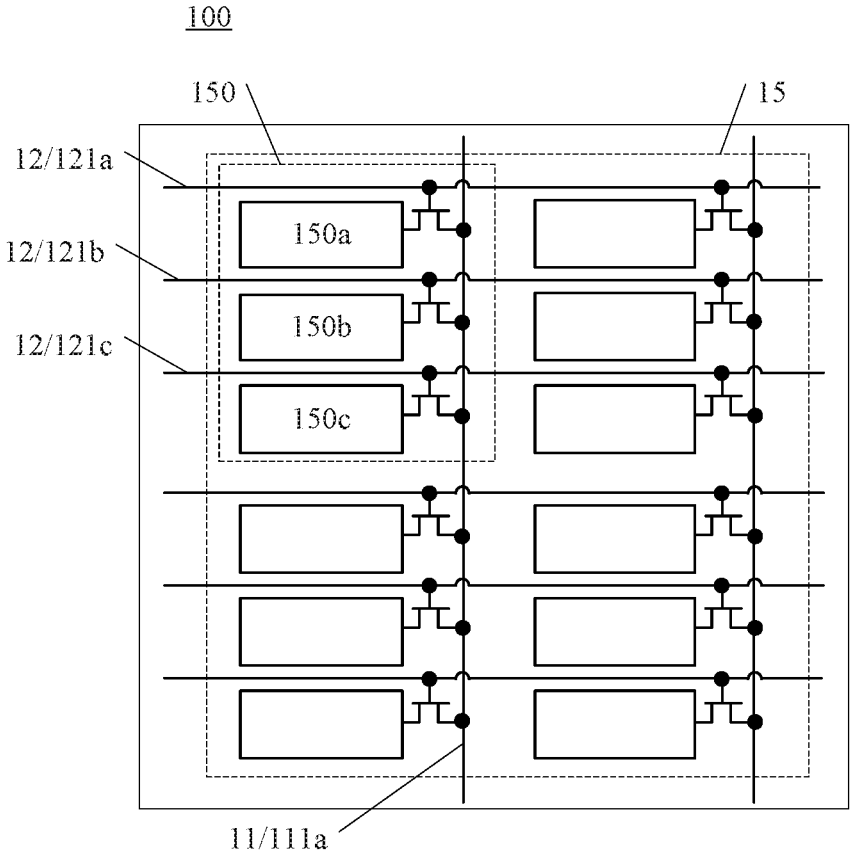
FIG. 5 is a schematic diagram of another display panel provided by an embodiment of the present disclosure.

FIG. 5 is a schematic diagram of another display panel provided by an embodiment of the present disclosure.

For example, in some embodiments, each pixel of the pixel array includes a plurality of sub-pixels, the plurality of sub-pixels are respectively connected to different gate lines and connected to the same data line in each pixel. As shown in FIG. 5, the first sub-pixel 150*a*, the second sub-pixel 150*b*, and the third sub-pixel 150*c* in the communication pixel 150 are connected to the first communication gate line 121*a*, the second communication gate line 121*b*, and the third communication gate line 121*c*, respectively. The first sub-pixel 150*a*, the second sub-pixel 150*b*, and the third sub-pixel 150*c* of the communication pixel 150 are all connected to the first communication data line 111*a*. At this time, the first communication data line 111*a* transmits the first data signal D1, the second data signal D2, and the third data signal D3 to the first sub-pixel 150*a*, the second sub-pixel 150*b*, and the third sub-pixel 150*c* in a time-sharing manner. It should be noted that, for example, the data line 11 may also include a first communication data line 111*a*, a second communication data line 111*b*, and a third communication data line 111*c*, and may transmit the first data signal D1, the second data signal D2, and the third data signal D3 to the first sub-pixel 150*a*, the second sub-pixel 150*b*, and the third sub-pixel 150*c*, respectively, which is not limited by the embodiment of the present disclosure.

Figure 6A:
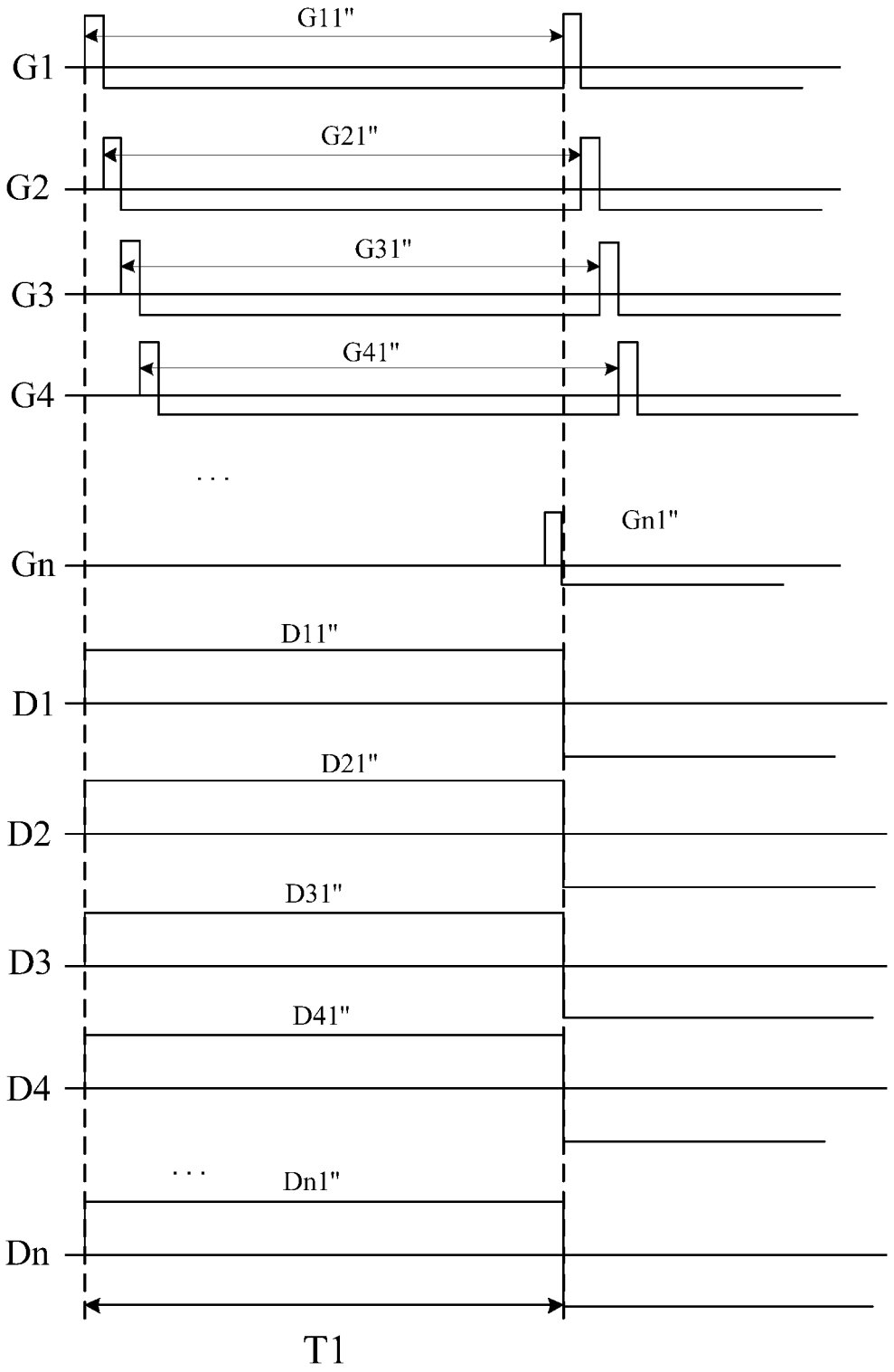
FIG. 6A is a driving timing diagram of a display panel provided by an embodiment of the present disclosure.
Figure 6B:
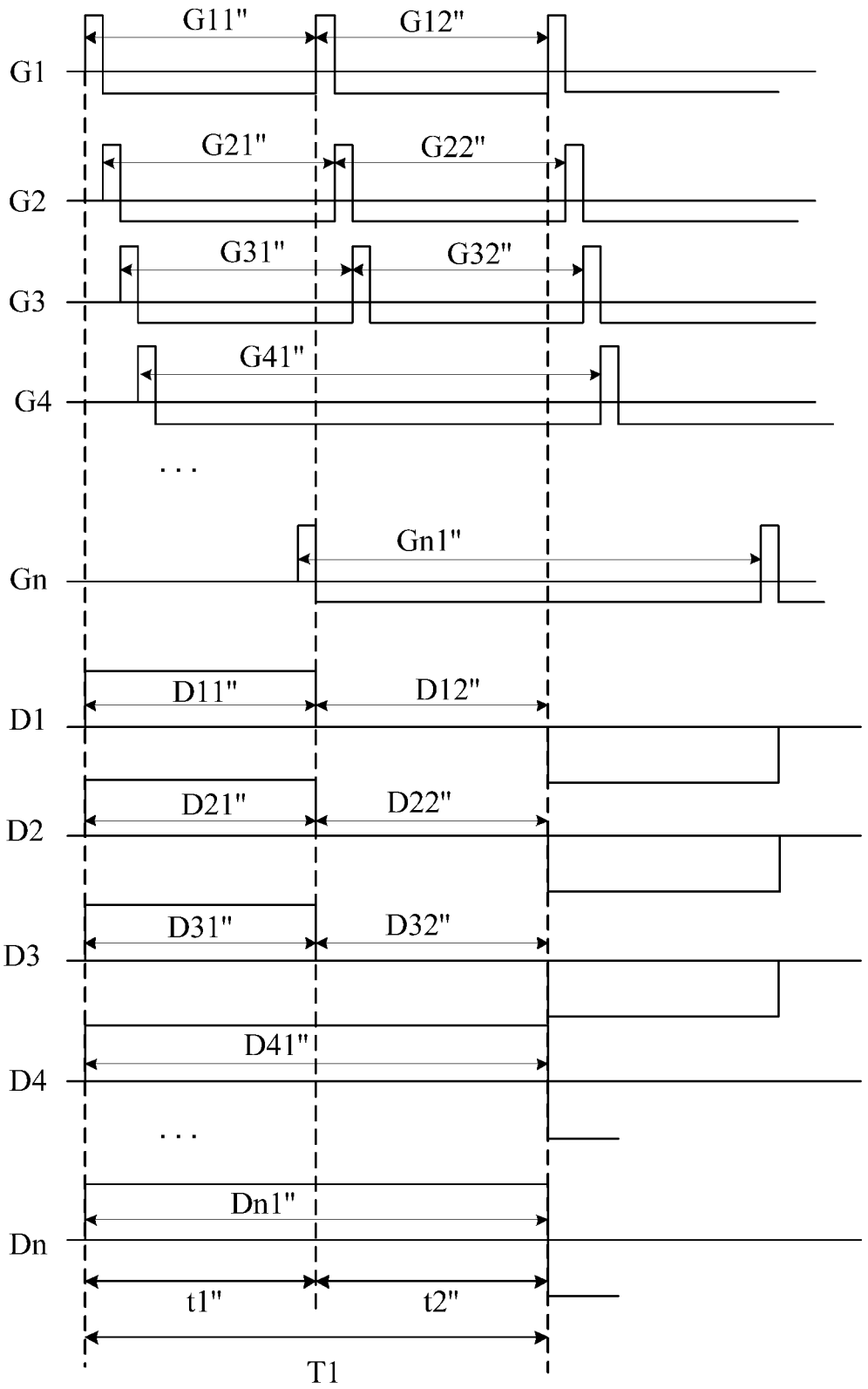
FIG. 6B is another driving timing diagram of a display panel provided by an embodiment of the present disclosure.

FIG. 6A is a driving timing diagram of a display panel provided by an embodiment of the present disclosure, and FIG. 6B is another driving timing diagram of a display panel provided by an embodiment of the present disclosure.

For example, as shown in FIGS. 2A, 6A and 6B, a first scan signal G1 may be a scan signal applied to the first sub-pixel 150*a* of the communication pixel 150, that is, a signal transmitted by the first communication gate line 121*a* shown in FIG. 2A; a second scan signal G2 may be a scan signal applied to the second sub-pixel 150*b* of the communication pixel 150, that is, a signal transmitted by the second communication gate line 121*b* shown in FIG. 2A; a third scan signal G3 may be a scan signal applied to the third sub-pixel 150*c* of the communication pixel 150, that is, a signal transmitted by the third communication gate line 121*c* shown in FIG. 2A; a fourth scan signal G4 may be a scan signal applied to the first sub-pixel 153*a* of the third non-communication pixel 153, that is, a signal transmitted by the first non-communication gate line 122*a* shown in FIG. 2A; an Nth scan signal Gn may be a scan signal applied to the third sub-pixel 153*c* of the third non-communication pixel 153, that is, a signal transmitted by the third non-communication gate line 122*c* shown in FIGS. 2A, *n* and N are integers greater than 4. For example, in the embodiment of the present disclosure, each of n and N may be 6.

For example, as shown in FIGS. 2A, 6A and 6B, a first data signal D1 may be a data signal applied to the first sub-pixel 150*a* of the communication pixel 150, that is, a signal transmitted by the first communication data line 111*a* shown in FIG. 2A; a second data signal D2 may be a data signal applied to the second sub-pixel 150*b* of the communication pixel 150, that is, a signal transmitted by the second communication data line 111*b* shown in FIG. 2A; a third data signal D3 may be a data signal applied to the third sub-pixel 150*c* of the communication pixel 150, that is, a signal transmitted by the third communication data line 111*c* shown in FIG. 2A; a fourth data signal D4 may be a data signal applied to the first sub-pixel 153*a* of the third non-communication pixel 153, that is, a signal transmitted by the first non-communication data line 112*a* shown in FIG. 2A; an Nth data signal Dn may be a data signal applied to the third sub-pixel 153*c* of the third non-communication pixel 153, that is, a signal transmitted by the third non-communication data line 112*c* shown in FIG. 2A.

For example, as shown in FIG. 6A, in case of normal display (without inserting communication information), in the first frame T1, the first scan signal G1 includes only a display scan sub-signal G11", the second scan signal G2 includes only a display scan sub-signal G21", the third scan signal G3 includes only a display scan sub-signal G31", the fourth scan signal G4 includes only a display scan sub-signal G41", and the N-th scan signal Gn includes only a display scan sub-signal Gn1".

The first data signal D1 includes only a corresponding first display data sub-signal D11", the second data signal D2 includes only a corresponding second display data sub-signal D21", the third data signal D3 includes only a corresponding third display data sub-signal D31", the fourth data signal D4 includes only a corresponding fourth display data sub-signal D41", and the Nth data signal Dn includes only a corresponding Nth display data sub-signal Dn1".

For example, as shown in FIG. 6A, in a frame (for example, the first frame T1), the first data signal D1, the second data signal D2, the third data signal D3, the fourth data signal D4, and the Nth data signal Dn change synchronously, that is, the first display data sub-signal D11", the second display data sub-signal D21", the third display data sub-signal D31", the fourth display data sub-signal D41", and the Nth display data sub-signal Dn1" are simultaneously applied to the first communication data line 111*a*, the second communication data line 111*b*, the third communication data line 111*c*, and the first non-communication data line 112*a* to the third non-communication data line 112*c*, respectively.

For example, as shown in FIG. 6B, in case of inserting communication information, the first scan signal G1, the second scan signal G2, and the third scan signal G3 are applied to the communication pixel 150, and the fourth scan signal G4 and the Nth scan signal Gn are applied to non-communication pixels (for example, the third non-communication pixel 153), so in the first frame T1, the first scan signal G1 includes the display scan sub-signal G11" and the first communication scan sub-signal G12", the second scan signal G2 includes the display scan sub-signal G21" and the second communication scan sub-signal G22", the third scan signal G3 includes the display scan sub-signal G31" and the third communication scan sub-signal G32", the fourth scan signal G4 (connecting the first sub-pixel 153*a* of the third non-communication pixel 153) includes only the display scan sub-signal G41", and the N-th scan signal Gn includes only the display scan sub-signal Gn1". The first data signal D1 includes the corresponding first display data sub-signal D11" and the first communication data sub-signal D12", the second data signal D2 includes the corresponding second display data sub-signal D21" and the second communication data sub-signal D22", the third data signal D3 includes the corresponding third display data sub-signal D31" and the third communication data sub-signal D32", the fourth data signal D4 includes only the corresponding fourth display data sub-signal D41", and the Nth data signal Dn includes only the corresponding Nth display data sub-signal Dn1". For example, as shown in FIG. 6B, in a frame (for example, the first frame T1), the first data signal D1, the second data signal D2, and the third data signal D3 change synchronously, that is, the first display data sub-signal D11", the second display data sub-signal D21" and the third display data sub-signal D31" are simultaneously applied to the first communication data line 111*a*, the second communication data line 111*b*, and the third communication data line 111*c*, respectively, and the first communication data sub-signal D12", the second communication data sub-signal D22", and the third communication data sub-signal D32" are also simultaneously applied to the first communication data line 111*a*, the second communication data line 111*b*, and the third communication data line 111*c*, respectively. In a frame (for example, the first frame T1), the fourth data signal D4 and the Nth data signal Dn are synchronously changed, that is, the fourth display data sub-signal D41" and the Nth display data sub-signal Dn1" are simultaneously applied to the first non-communication data line 112*a* and the third non-communication data line 112*c*, respectively.

For example, in the first frame T1, the display time is C. In the case shown in FIG. 6A, the scanning time of the display panel is the same as the display time of the first frame T1, both of which are C. Thus, during the time t", the gate lines 12 on the display panel 100 perform a scanning operation, and all pixels on the display panel 100 operate normally. In the case shown in FIG. 6B, the scan time of the display panel is shorter than the display time of the first frame T1. For example, the scan time of the display panel is t1", and t1" may be t"/2, so that during the time t1", the gate lines 12 on the display panel 100 perform a scanning operation, all pixels on the display panel 100 operate normally, and the communication pixel 150 displays the light state information; during the time t2", the communication pixels 150 in the display panel 100 display dark state information, and thus the communication pixels 150 realize light-dark changes to transmit communication information. During the time t1" and t2", non-communication pixels operate normally.

Figure 7A:
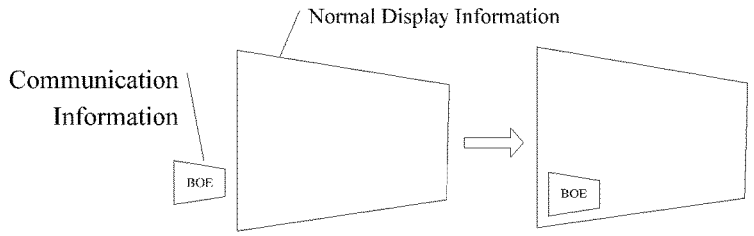
FIG. 7A is a schematic diagram of a first application example of a display panel provided by an embodiment of the present disclosure.
Figure 7B:
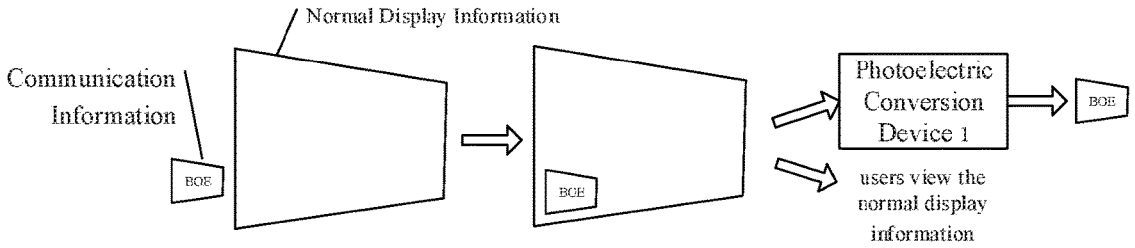
FIG. 7B is a schematic diagram of a second application example of a display panel provided by an embodiment of the present disclosure.
Figure 7C:
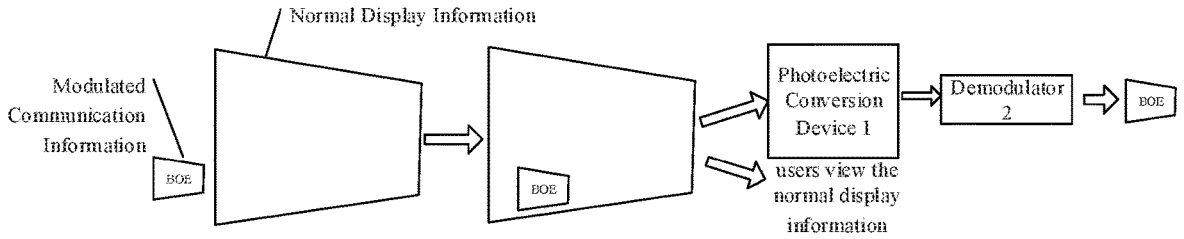
FIG. 7C is a schematic diagram of a third application example of a display panel provided by an embodiment of the present disclosure.

FIG. 7A is a schematic diagram of a first application example of a display panel provided by an embodiment of the present disclosure, FIG. 7B is a schematic diagram of a second application example of a display panel provided by an embodiment of the present disclosure, and FIG. 7C is a schematic diagram of a third application example of a display panel provided by an embodiment of the present disclosure.

For example, in some embodiments, the display panel 100 may be used to provide anti-counterfeiting information. As shown in FIG. 7A, communication pixels are used to display communication information which may be an anti-counterfeiting mark on the display panel 100. The user may observe the anti-counterfeiting mark (for example, the anti-counterfeiting mark is three letters of BOE) on the display panel 100 by using an identification device. The frequency of the identification signal of the identification device is higher than the refresh frequency of the display panel 100.

For example, in some embodiments, the display panel 100 may be used for a terminal (e.g., a cell phone, etc.) to read communication information. As shown in FIG. 7B, on the display panel 100, communication pixels are used to transmit communication information of a specific frequency (for example, 200 Hz). At the terminal, the optical signal of the communication pixel may be detected by the user through the photoelectric conversion device 1, and then the optical signal is converted into an electrical signal; finally, the electrical signal may be read by the terminal to obtain communication information.

For example, in some embodiments, the display panel 100 may be used to transmit information, for example, the display panel 100 may function as a wireless route (e.g., Li-Fi). As shown in FIG. 7C, on the display panel 100, the communication information for transmitting a specific frequency (for example, 200 Hz) is modulated by a modulator (not shown) of the display panel 100, and then the modulated communication information is transmitted through the communication pixel. At the terminal, an optical signal of the communication pixel may be detected by the user through the photoelectric conversion device 1, and the optical signal is converted into an electrical signal (light and dark indicate 1 and 0, respectively); then, the electrical signal may be transmitted to the demodulator 2, and may be obtained by the demodulator 2 to obtain communication information transmitted by the communication pixel; finally, the communication information transmitted by the communication pixel may be converted into information required by the terminal (for example, text, picture, etc.) to achieve the transmission of information.

For example, the display panel 100 provided by the embodiment of the present disclosure may be applied to any product or component having a display function, such as a mobile phone, a tablet computer, a television, a display, a notebook computer, a digital photo frame, a navigator, etc.

Figure 8:
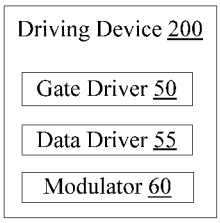
FIG. 8 is a schematic block diagram of a driving device provided by an embodiment of the present disclosure.

An embodiment of the present disclosure further provides a driving device that may be applied to the display panel according to any of the above embodiments. FIG. 8 is a schematic block diagram of a driving device provided by an embodiment of the present disclosure.

For example, as shown in FIG. 8, the driving device 200 provided by an embodiment of the present disclosure includes a gate driver 50 and a data driver 55. The gate driver 50 is configured to output a first scan signal to the first communication gate line; and the data driver 55 is configured to output a first data signal to the first communication data line.

For example, the first scan signal includes a display scan sub-signal and a first communication scan sub-signal, and the first data signal includes a first display data sub-signal and a first communication data sub-signal.

For example, the gate driver 50 is also configured to output a second scan signal and a third scan signal to the second communication gate line and the third communication gate line, respectively; correspondingly, the data driver 55 is also configured to output a second data signal and a third data signal to the second communication data line and the third communication data line, respectively.

For example, the second scan signal includes a corresponding display scan sub-signal and a second communication scan sub-signal, and the third scan signal includes a corresponding display scan sub-signal and a third communication scan sub-signal; the second data signal includes a second display data sub-signal and a second communication data sub-signal, and the third data signal includes a third display data sub-signal and a third communication data sub-signal.

For example, the communication pixel includes a first sub-pixel, a second sub-pixel, and a third sub-pixel, and the communication sub-pixel is the first sub-pixel of the communication pixel.

For example, as shown in FIG. 8, the drive device 200 also includes a modulator 60. The modulator 60 is configured to determine the first communication scan sub-signal and the first communication data sub-signal based on the communication information transmitted by the communication sub-pixel.

For example, if the second sub-pixel and the third sub-pixel are non-communication sub-pixels, the modulator 60 is also configured to determine the second communication scan sub-signal, the third communication scan sub-signal, the second communication data sub-signal, and the third communication data sub-signal based on the first communication scan sub-signal and the first communication data sub-signal.

For example, if the first sub-pixel, the second sub-pixel, and the third sub-pixel are different communication sub-pixels, the modulator 60 is also configured to determine the second communication scan sub-signal and the second communication data sub-signal based on the communication information transmitted by the second sub-pixel, and determine the third communication scan sub-signal and the third communication data sub-signal based on the communication information communicated by the third sub-pixel.

For example, the modulator 60 may be of any type, such as a digital modulator, an analog modulator, etc.

For example, the drive device 200 may also include a timing controller. The timing controller is configured to provide control commands and/or timing signals to the gate driver 50, the data driver 55, and the modulator 60 to cause the gate driver 50, the data driver 55, and the modulator 60 to cooperate.

It should be noted that detailed descriptions about the communication pixel, the first scan signal, the second scan signal, the third scan signal, the first data signal, the second communication data line, and the third communication data line may refer to the related description in the above-described embodiment of the display panel, which will not be repeated.

Figure 9:
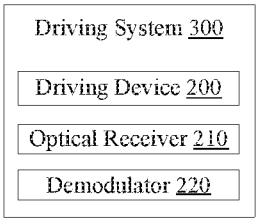
FIG. 9 is a schematic block diagram of a driving system provided by an embodiment of the present disclosure.

An embodiment of the present disclosure further provides a driving system. FIG. 9 is a schematic block diagram of a driving system provided by an embodiment of the present disclosure. For example, as shown in FIG. 9, the drive system 300 may include the drive device 200 according to any of the above-described embodiments, an optical receiver 210, and a demodulator 220. The optical receiver 210 is configured to detect an optical signal of the communication sub-pixel, convert the optical signal into an electrical signal, and transmit the electrical signal to the demodulator 220; the demodulator 220 is configured to demodulate the electrical signal to obtain communication information transmitted by the communication sub-pixels.

For example, the demodulator 220 is also configured to convert communication information transmitted by the communication sub-pixels to obtain target information. The target information may be information that the terminal (for example, a mobile phone, a computer, etc.) requires, and the target information may be texts, pictures, videos, etc.

For example, the drive device 200 may be disposed at a transmitting side of the communication information, and the optical receiver 210 and the demodulator 220 may be disposed at a receiving side of the communication information. For example, the transmitting side of the communication information may be a display panel, and the receiving side of the communication information may be a mobile terminal such as a mobile phone or a tablet computer.

For example, the optical receiver 210 may include a charge coupled device (CCD), a complementary metal oxide semiconductor (CMOS), etc.

It should be noted that the detailed description of the driving device 200 may refer to the related description in the above-described embodiment of the driving device, which will not be repeated.

Figure 10:
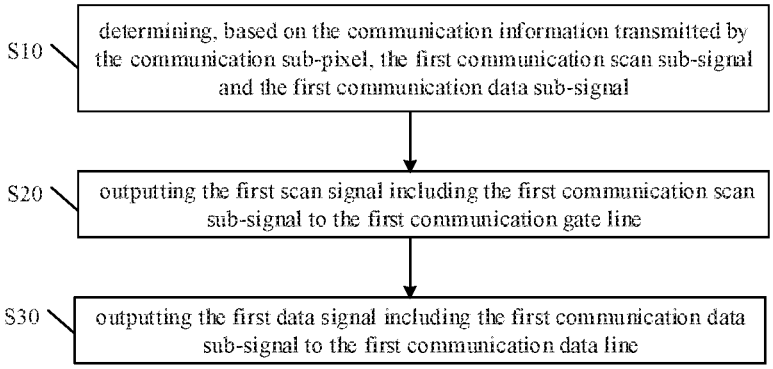
FIG. 10 is a schematic flowchart of a driving method provided by an embodiment of the present disclosure.

An embodiment of the present disclosure also provides a driving method applied to any of the above-mentioned display panels. FIG. 10 is a schematic flowchart of a driving method provided by an embodiment of the present disclosure. For example, as shown in FIG. 10, the driving method provided by the embodiment of the present disclosure may include the following steps.

Step S10: determining, based on the communication information transmitted by the communication sub-pixel, the first communication scan sub-signal and the first communication data sub-signal.

Step S20: outputting the first scan signal including the first communication scan sub-signal to the first communication gate line.

Step S30: outputting the first data signal including the first communication data sub-signal to the first communication data line.

For example, the communication pixel may include a first sub-pixel, a second sub-pixel, and a third sub-pixel, and the communication sub-pixel is the first sub-pixel of the communication pixel. In step S10, if the second sub-pixel and the third sub-pixel are non-communication sub-pixels, the step S10 further includes determining a second communication scan sub-signal, a third communication scan sub-signal, a second communication data sub-signal, and a third communication data sub-signal based on the first communication scan sub-signal and the first communication data sub-signal. If the first sub-pixel, the second sub-pixel, and the third sub-pixel are different communication sub-pixels, the step S10 further includes determining, based on the communication information transmitted by the second sub-pixel, the second communication scan sub-signal and the second communication data sub-signal, and determining, based on the communication information transmitted by the third sub-pixel, the third communication scan sub-signal and the third communication data sub-signal.

For example, the step S20 may further include outputting a second scan signal including a second communication scan sub-signal to the second communication gate line, and outputting a third scan signal including the third communication scan sub-signal to the third communication gate line.

For example, each of the first scan signal, the second scan signal, and the third scan signal further includes a corresponding display scan sub-signal.

For example, the step S30 may further include outputting a second data signal including the second communication data sub-signal to the second communication data line, and outputting the third data signal including the third communication data sub-signal to the third communication data line.

For example, the first data signal further includes a first display data sub-signal, the second data signal further includes a second display data sub-signal, and the third data signal further includes a third display data sub-signal.

For example, in step S20, the first communication scan sub-signal, the second communication scan sub-signal, and the third communication scan sub-signal are output in a time-sharing manner through the first communication gate line, the second communication gate line, and the third communication gate line, respectively; the display scan sub-signal of the first scan signal, the display scan sub-signal of the second scan signal, and the display scan sub-signal of the third scan signal are also output in a time-sharing manner through the first communication gate line, the second communication gate line, and the third communication gate line, respectively. In step S30, the first communication data sub-signal, the second communication data sub-signal, and the third communication data sub-signal are simultaneously output through the first communication data line, the second communication data line, and the third communication data line, respectively; the first display data sub-signal, the second display data sub-signal, and the third display data sub-signal are also simultaneously output through the first communication data line, the second communication data line, and the third communication data line, respectively.

It should be noted that detailed descriptions about the communication pixel, the first scan signal, the second scan signal, the third scan signal, the first data signal, the second communication data line, and the third communication data line may refer to the related description in the above-described embodiment of the display panel, which will not be repeated.

The following statements should be noted:

(1) The accompanying drawings involve only the structure(s) in connection with the embodiment(s) of the present disclosure, and other structure(s) can be referred to common design(s).

(2) In case of no conflict, features in one embodiment or in different embodiments can be combined to obtain new embodiments.

What are described above is related to the illustrative embodiments of the disclosure only and not limitative to the scope of the disclosure; the scopes of the disclosure are defined by the accompanying claims.

What is claimed is:

1. A display panel, comprising a plurality of data lines, a plurality of gate lines, and a pixel array, wherein the pixel array comprises a communication pixel comprising a communication sub-pixel, a gate line of the plurality of gate lines connected to the communication sub-pixel is a first communication gate line, and a data line of the plurality of data lines connected to the communication sub-pixel is a first communication data line;

the first communication gate line is configured to transmit a first scan signal, the first scan signal comprises a display scan sub-signal and a first communication scan sub-signal, the first communication data line is configured to transmit a first data signal, the first data signal comprises a first display data sub-signal and a first communication data sub-signal;

the communication sub-pixel is configured to display information corresponding to the first display data sub-signal and information corresponding to the first communication data sub-signal in a time-sharing manner under a control of the display scan sub-signal and the first communication scan sub-signal;

each pixel of the pixel array comprises a plurality of sub-pixels, in the each pixel, the plurality of sub-pixels are respectively connected to different gate lines and respectively connected to different data lines;

the communication sub-pixel is a first sub-pixel of the communication pixel, the communication pixel further comprises a second sub-pixel and a third sub-pixel, a gate line of the plurality of gate lines connected to the second sub-pixel of the communication pixel is a second communication gate line, and a gate line of the plurality of gate lines connected to the third sub-pixel of the communication pixel is a third communication gate line, a data line of the plurality of data lines connected to the second sub-pixel of the communication pixel is a second communication data line, and a data line of the plurality of data lines connected to the third sub-pixel of the communication pixel is a third communication data line, the second communication gate line is configured to transmit a second scan signal, the second scan signal comprises a corresponding display scan sub-signal and a second communication scan sub-signal, and the third communication gate line is configured to transmit a third scan signal, the third scan signal comprises a display scan sub-signal and a third communication scan sub-signal, and the second communication data line is configured to transmit a second data signal, the second data signal comprises a second display data sub-signal and a second communication data sub-signal, and the third communication data line is configured to transmit a third data signal, the third data signal comprises a third display data sub-signal and a third communication data sub-signal.

2. The display panel according to claim 1, wherein the second sub-pixel and the third sub-pixel are non-communication sub-pixels, and the second communication scan sub-signal and the third communication scan sub-signal are associated with the first communication scan sub-signal.

3. The display panel according to claim 2, wherein the first communication data sub-signal, the second communication data sub-signal, and the third communication data sub-signal are all dark-state signals, and the first display data sub-signal is a light-state signal.

4. The display panel according to claim 1, wherein the first sub-pixel, the second sub-pixel, and the third sub-pixel are different communication sub-pixels, and the first communication scan sub-signal, the second communication scan sub-signal, and the third communication scan sub-signal are determined based on communication information transmitted by the first sub-pixel, the second sub-pixel, and the third sub-pixel, respectively.

5. The display panel according to claim 4, wherein the first communication data sub-signal, the second communication data sub-signal, and the third communication data sub-signal are all dark-state signals, and the first display data sub-signal, the second display data sub-signal, and the third display data sub-signal are all light-state signals.

6. The display panel according to claim 1, wherein the plurality of data lines extend in a first direction, and the plurality of gate lines extend in a second direction, in the each pixel, colors of the plurality of sub-pixels are different from each other, and the plurality of sub-pixels are sequentially arranged in the first direction;

the plurality of gate lines are configured to be connected to sub-pixels of a same color in a same line in the second direction, respectively; and the plurality of data lines are configured to be connected to sub-pixels of a same color in a same line in the first direction, respectively.

7. The display panel according to claim 1, wherein gate lines of the plurality of gate lines connected to non-communication pixels are configured to transmit corresponding display scan sub-signals, data lines of the plurality of data lines connected to the non-communication pixels are configured to transmit corresponding display data sub-signals, respectively, the non-communication pixels are configured to display information corresponding to the corresponding display data sub-signals, respectively.

8. The display panel according to claim 1, wherein each pixel of the pixel array comprises a plurality of sub-pixels, in the each pixel, the plurality of sub-pixels are respectively connected to different gate lines and connected to a same data line.

9. The display panel according to claim 1, wherein communication information transmitted by the communication sub-pixel is determined by a light-dark frequency of an optical signal emitted by the communication sub-pixel.

10. A driving device configured to be applied to the display panel according to claim 1, the driving device comprising a gate driver and a data driver, wherein the gate driver is configured to output the first scan signal to the first communication gate line; and the data driver is configured to output the first data signal to the first communication data line.

11. The driving device according to claim 10, further comprising a modulator, wherein the modulator is configured to determine the first communication scan sub-signal and the first communication data sub-signal based on communication information transmitted by the communication sub-pixel.

12. A drive system, comprising the drive device according to claim 10, an optical receiver and a demodulator, wherein the optical receiver is configured to detect an optical signal of the communication sub-pixel, convert the optical signal into an electrical signal, and transmit the electrical signal to the demodulator, and the demodulator is configured to demodulate the electrical signal to obtain communication information transmitted by the communication sub-pixel.

13. A driving method of the display panel according to claim 1, the method comprising:

determining the first communication scan sub-signal and the first communication data sub-signal, based on the communication information transmitted by the communication sub-pixel;

outputting, to the first communication gate line, the first scan signal comprising the first communication scan sub-signal; and outputting, to the first communication data line, the first data signal comprising the first communication data sub-signal.

14. The driving system according to claim 12, wherein the driving device further comprises a modulator, wherein the modulator is configured to determine the first communication scan sub-signal and the first communication data sub-signal based on communication information transmitted by the communication sub-pixel.

15. The display panel according to claim 2, wherein communication information transmitted by the communication sub-pixel is determined by a light-dark frequency of an optical signal emitted by the communication sub-pixel.

16. The display panel according to claim 3, wherein communication information transmitted by the communication sub-pixel is determined by a light-dark frequency of an optical signal emitted by the communication sub-pixel.

* * * * *